US007557071B2

(12) United States Patent
Sarkis et al.

(10) Patent No.: US 7,557,071 B2
(45) **Date of Patent: *Jul. 7, 2009**

(54) WAX-BASED LUBRICANTS FOR CONVEYORS

(75) Inventors: Michael T. Sarkis, Racine, WI (US); Paul F. Lewis, Lake Geneva, WI (US); Carmine Savaglio, Kenosha, WI (US)

(73) Assignee: Johnsondiversy, Inc., Sturtevant, WI (US)

( * ) Notice: Subject to any disclaimer, the term of this patent is extended or adjusted under 35 U.S.C. 154(b) by 702 days.

This patent is subject to a terminal disclaimer.

(21) Appl. No.: 10/970,674

(22) Filed: Oct. 21, 2004

(65) Prior Publication Data

US 2006/0089274 A1 Apr. 27, 2006

(51) Int. Cl.
*C08J 7/04* (2006.01)

(52) U.S. Cl. ..... 508/101; 508/110; 508/451; 508/591; 427/421.1

(58) Field of Classification Search ..... 508/101, 508/157, 175, 451, 591, 450; 198/500; 427/11, 427/421.1

See application file for complete search history.

(56) References Cited

U.S. PATENT DOCUMENTS

| | | | | |
|---|---|---|---|---|
| 2,587,017 | A | 2/1952 | Weber | |
| 2,813,045 | A | 11/1957 | Abbott, Jr. | |
| 3,323,889 | A | 6/1967 | Carl et al. | |
| 3,438,801 | A | 4/1969 | Schlientz et al. | |
| 3,445,275 | A | 5/1969 | Bogart | |
| 3,525,636 | A | 8/1970 | Bogart | |
| 3,713,867 | A | 1/1973 | Parkinson et al. | |
| 3,937,676 | A | 2/1976 | Shonebarger et al. | |
| 3,998,986 | A | 12/1976 | Williams | |
| 5,043,380 | A | 8/1991 | Cole | |
| 5,559,087 | A | 9/1996 | Halsrud et al. | |
| 5,660,865 | A * | 8/1997 | Pedersen et al. | 426/99 |
| 6,190,738 | B1 | 2/2001 | Beck | |
| 6,585,794 | B2 * | 7/2003 | Shimoda et al. | 55/527 |
| 7,091,162 | B2 * | 8/2006 | Lewis et al. | 508/165 |
| 2003/0207040 | A1 * | 11/2003 | Bennett et al. | 427/421 |
| 2005/0003973 | A1 * | 1/2005 | Lewis et al. | 508/513 |

FOREIGN PATENT DOCUMENTS

| | | |
|---|---|---|
| WO | WO 2005/007785 | 1/2005 |

OTHER PUBLICATIONS

International Search Report dated Sep. 8, 2005 for PCT/US2005/017568.

* cited by examiner

*Primary Examiner*—Glenn A Caldarola
*Assistant Examiner*—Taiwo Oladapo
(74) *Attorney, Agent, or Firm*—Foley & Lardner LLP

(57) ABSTRACT

Wax-based lubricant coatings for conveyors, and in particular for container transporting conveyors, are provided. The lubricant coatings provide conveyor surfaces having low coefficients of friction. In one embodiment, the lubricant coatings are composed of a mixture of carnauba wax and at least one additional wax. Conveyors having the lubricant coatings applied thereto are also provided.

20 Claims, 3 Drawing Sheets

WAX-BASED LUBRICANTS FOR CONVEYORS

FIELD OF THE INVENTION

The present invention relates to lubricants for conveyors. More particularly, the present invention concerns the use of wax-based lubricant coatings which provide a durable lubricating coating on conveyor surfaces.

BACKGROUND OF THE INVENTION

In many areas of manufacturing, including drink bottling and food processing plants, conveyors are used to move containers such as bottles, jars, cans, and the like between locations. In order to maintain line efficiency, keep the containers and conveyor parts clean, and provide lubrication, it is customary to use a lubricant, typically an aqueous, soap-based or synthetic lubricant. These lubricants are generally sold as concentrates designed to be heavily diluted prior to or during use. For example, a typical dilution ratio might be 1:100 or even greater.

Unfortunately, these conventional lubricants present certain disadvantages. For example, due to the heavy dilution, these lubricants tend to drip from the surfaces onto which they are coated, creating a safety hazard in plants and requiring constant clean-up efforts. In addition, the conventional lubricants typically require frequent or constant reapplication which adds to the cost and inefficiency of the lubricating process. Known lubricants are frequently incompatible with containers and/or conveyor parts. For example, many commercially available lubricants cause stress cracking in polyethylene terephthalate (PET) bottles.

Thus a need exists for a conveyor lubricant that is cost effective and efficient to apply and reapply, and is compatible with containers and conveyor parts.

SUMMARY OF THE INVENTION

The present invention provides wax-based lubricant coatings for conveyors, methods for applying the lubricant coatings to conveyors, and conveyors coated with the lubricant coatings. The wax-based lubricant coatings provided herein produce conveyor surfaces having low coefficients of friction, in some instances coefficients of friction lower than 0.15. In addition to the lubrication, the lubricant coatings provide durability to conveyor parts to which they are applied and result in increased safety, hygiene, and water savings in the facilities where they are used. In some embodiments, the lubricant coatings are composed of at least 70 weight percent (wt. %) of one or more waxes, such as camauba wax and/or polyethylene waxes.

The lubricant coatings may be formed from a liquid lubricant composition containing the one or more waxes in a liquid carrier, such as water, an organic solvent or a mixture of water and one or more organic solvents. To form the lubricant coatings, the liquid lubricant compositions are applied to at least a portion of a conveying surface. After application of the liquid lubricant composition the volatile components of the composition evaporate to provide the wax-based lubricant coating. In some embodiments, the liquid lubricant compositions are composed of no more than about 60 wt. % wax, based on the total weight of the liquid lubricant composition.

A wide variety of waxes may be used in the liquid lubricant compositions and lubricant coatings provided herein. However, preferred waxes desirably have high hardness and high crystallinity. Carnauba wax is an example of a wax that is well suited for conveyor lubricating applications. Other suitable waxes include, but are not limited to, vegetable waxes, animal based waxes, synthetic waxes, and mineral waxes and mixtures thereof.

Conveyors lubricated with the wax-based lubricant coatings presented herein are also provided.

DETAILED DESCRIPTION

Figure 1:
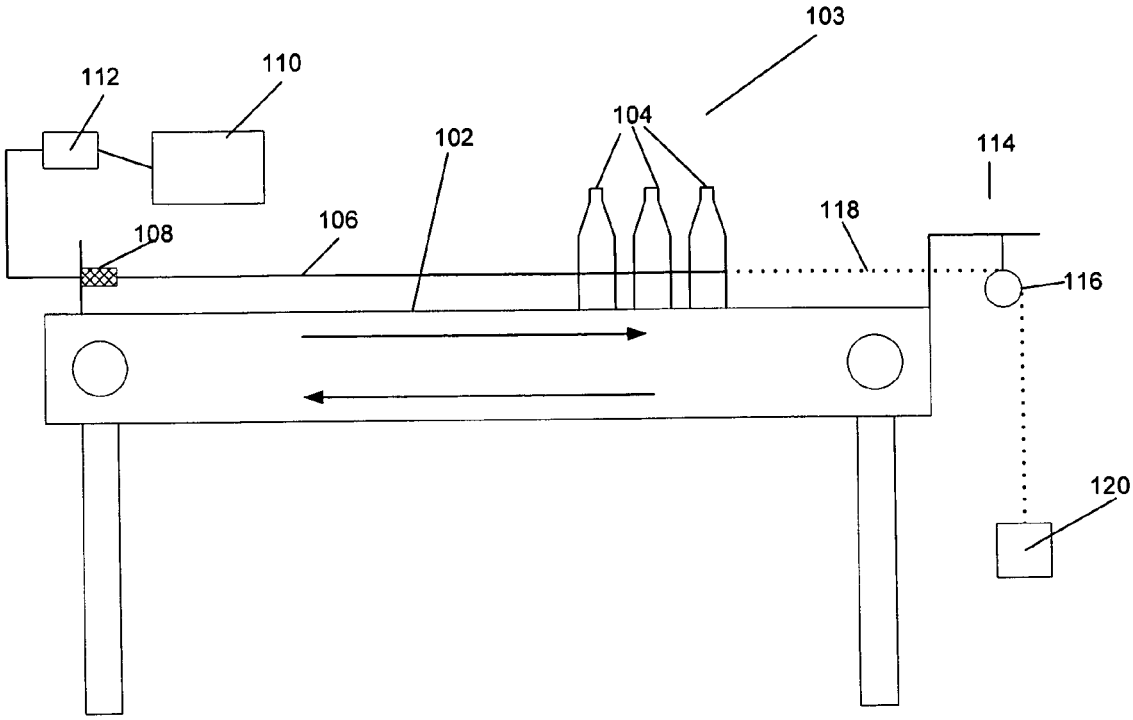
FIG. 1 shows a laboratory conveyor setup used to obtain coefficient of friction values for the wax-based lubricant coatings using a short track conveyor test.

In accordance with the present invention, wax-based conveyor lubricant coatings which provide conveyor surfaces having low coefficients of friction are prepared from various waxes. In some embodiments, the wax-based lubricant coatings provide a coefficient of friction of no more than about 0.15 as measured by a short track conveyor test. The wax-based lubricant coatings provided herein are well suited for use with conveyors used to transport containers such as bottles and cans. The lubricant coatings may be formed from a liquid lubricant composition that contains one or more waxes in a liquid carrier. Thus, for the purposes of this disclosure the term "lubricant coating" refers to the coating left on a surface (e.g., a conveyor belt surface) after the liquid lubricant composition has been allowed to dry.

The wax-based lubricant coatings of the present invention have several advantages in comparison to other conveyor lubricants presently available. First, the wax-based lubricant coatings are durable and contain little water or solvent. The coatings are semi-permanent and, as such, need only be reapplied rarely compared to conventional water-based lubricants. This saves the time and expense associated with the need to constantly reapply lubricants to a conveyor system and eliminates the problems associated with lubricant dripping from a conveyor surface onto a floor. The wax-based lubricant coatings are easily renewed and repaired by simply reapplying a liquid lubricant composition containing a wax or wax mixture to worn or damaged portions of the conveyor and allowing the liquid lubricant compositions to dry into a lubricant coating.

Parts of a conveyor system that may be partially or wholly coated with the lubricant coatings provided herein include any part that has the potential to impede the movement of an object, such as a container, moving along the conveyor. Examples of suitable parts include, but are not limited to, conveyor belts, tracks, chains, and chute guides. When used on a container conveyor, the lubricant coatings may be applied to any container-contacting portion of the conveyor system. These conveyor parts may be made from a variety of materials including plastics and metals. In one embodiment, the lubricant coatings are applied to stainless steel conveyor parts. The lubricant coatings are capable of providing a lubricated surface for conveying objects made of a variety of materials including, but not limited to, plastic, glass, paper, metal and ceramics. Unlike many water-based lubricants, the wax-based lubricant coatings presented herein are not reactive toward common container materials. For example, the wax-based lubricant coatings do not cause stress-cracking in PET bottles.

The wax-based lubricant coatings contain at least one wax. For example, the lubricant coatings may be a mixture of at least two, at least three, at least four or even more different waxes. The waxes may be any waxes capable of producing a conveying surface with a reduced coefficient of friction either by themselves or in combination with other waxes. Many suitable waxes are known and commercially available. The waxes are desirably characterized by high hardness, high density and/or high crystallinity and have characteristic high penetration hardness and/or high melt viscosities. For example, a wax or a blend of waxes may be selected such that the wax or wax blend has an average hardness of no greater than about 10 dmm as measured by ASTM D-5, an average density of at least about 0.85 g/cc as measured by ASTM D-1505 and/or an average degree of crystallinity of at least about 30%.

Suitable waxes for use in the wax-based lubricant coatings provided herein include plant (e.g. vegetable), animal, insect, synthetic and/or mineral waxes. Specific examples of suitable waxes include, but are not limited to, candelilla wax, Fisher-Tropsch wax, oxidized petroleum waxes, microcrystalline waxes, lanolin wax, wax derived from cocoa butter, cottonseed wax, stearin wax, Japan wax, bayberry wax, myrtle wax, wax derived from mace, palm kernel wax, beeswax, spermaceti, Chinese insect wax, wax made from mutton tallow, polyethylene waxes, oxidized polyethylene waxes, polypropylene waxes, oxidized polypropylene waxes, waxes based on copolymers or propylene and acrylic acid and/or methacrylic acid and/or maleic anhydride, waxes based on copolymers of ethylene and acrylic esters and/or maleic anhydride, waxes based on copolymers of ethylene and acrylic acid and/or methacrylic acid and/or maleic anhydride, waxes based on copolymers of ethylene and styrene and/or other vinyl monomers, waxes obtained from the hydrogenation of coconut oil or soybean oil and mineral waxes such as paraffin, ceresin, montan, ozokerite, and the like. In some embodiments, the wax-based lubricant coatings and the liquid lubricant compositions from which the coatings are made contain a mixture of camauba wax and at least one additional wax.

The wax-based lubricant coatings provided herein contain at least 70 wt. % or at least about 70 wt. % of at least one wax. This includes embodiments wherein wax accounts for at least 80 wt. % or at least about 80 wt. % of the lubricant coating, further includes embodiments where wax accounts for at least 85 wt. % or at least about 85 wt. % of the lubricant coating, still further includes embodiments wherein wax accounts for at least 90 wt. % or at least about 90 wt. % of the lubricant coating, yet further includes embodiments where wax accounts for at least 95 wt. % or at least about 95 wt. % of the lubricant coating and even further includes embodiments wherein wax accounts for at least 98 wt. % or at least about 98 wt. % of the lubricant coating. The balance of the coating may be made up a variety of ingredients including, nonvolatile solvents (i.e., solvents remaining after a liquid lubricant composition is allowed to dry into a lubricant coating) and lubricant additives, such as those commonly found in conveyor lubricants and coatings. Suitable additives include, but are not limited to, anti-microbial agents, pigments, surfactants, emulsifying agents, including polymeric emulsifying agents, fatty acids and their salts, wetting and leveling agents, defoaming and antifoaming agents, organic and inorganic bases, ionic crosslinking agents, silicones and fluorinated polymers.

When a mixture of two or more waxes is used, the relative amount of each wax in the coating may vary depending on a variety of factors including the nature of the waxes selected, the nature of the surface to be coated, and the desired degree of lubricity. In some illustrative embodiments where the lubricant coating is composed of a mixture of a first wax and a second wax, the weight ratio of the first wax to the second wax in the coating may range from about 1:10 to 10:1. This includes embodiments where the weight ratio of the first wax to the second wax in the lubricant coating is from about 1:5 to 5:1, also includes embodiments where the weight ratio of the first wax to the second wax in the lubricant coating is about 1:3 3:1, further includes embodiments where the weight ratio of the first wax to the second wax is about 1:2 to 2:1 and further includes embodiments where the weight ratio of the first wax to the second wax is about 1:1.5 to 1.5:1. The inventors have discovered that lubricant coatings made from a mixture of carnauba wax and at least one additional wax are particularly well suited for use as conveyor lubricant coatings. In some embodiments where camauba wax is included in the coatings, the carnauba wax may be present at a level of at least about 20 wt. %. This includes embodiments where the carnauba wax makes up at least about 30 wt. % of the lubricant coating, further includes embodiments where carnauba wax makes up at least about 40 wt. % of the lubricant coating and still further includes embodiments where the carnauba wax makes up at least about 50 wt. % of the lubricant coating. In one embodiment, the lubricant coating is made up of a mixture of carnauba wax and oxidized polyethylene wax. In some such embodiments, the lubricant coating contains about 45-55 wt. % carnauba wax and about 45-55 wt. oxidized polyethylene wax. In other embodiments, carnauba wax is the only wax present in the lubricant coating.

Waxes and wax mixtures are typically applied to conveying surfaces as liquid lubricant compositions which are allowed to dry sufficiently to provide the wax-based lubricant coatings. The liquid lubricant compositions may be applied to a conveying surface through any of a variety of well known application methods. For example, the liquid compositions may be applied by spray coating, drip coating, dip coating, roll coating, or application by a brush, cloth, roller, pad or sponge. The liquid lubricant compositions include the wax or waxes, any optional additives and a suitable carrier. In some embodiments the carrier is water. In such embodiments the liquid lubricant compositions may be solutions, dispersions, or emulsions. The solutions, dispersions and emulsions may be aqueous or organic based. For example, the wax or waxes may be dissolved in an organic medium such as mineral spirits. If an aqueous medium is used, that medium may optionally include organic solvents. Alternatively the carrier may be a suitable organic solvent from solvent classes, such as hydrocarbon, aromatic hydrocarbon, ester, ketone, ether, phosphate ester, glycol ether based mono and dibenzoate, phthalate ester, glycol ether based on ethylene or propylene glycol, and pyrrolidone based solvents, or mixtures, for example. The wax content of the liquid lubricant compositions is generally no more than about 60 wt. %, based on the total weight of the liquid lubricant composition. This includes embodiments where the wax content of the liquid lubricant composition is no more than about 50 wt. %, further includes embodiments where the wax content of the liquid lubricant composition is no more than about 40 wt. %, further includes embodiments where the wax content of the liquid lubricant composition is no more than about 30 wt. %, further includes embodiments where the wax content of the liquid lubricant composition is no more than about 20 wt. % and still further includes embodiments where the wax content of the liquid lubricant composition is no more than about 10 wt. %. It should be noted that the wax may be added to the liquid lubricant composition in the form of an emulsion or dispersion. The wax contents cited above refer only to the amount of wax added to the compositions and do not include any other compounds, such as solvents or carriers, that are added as part of the wax emulsions or dispersions.

After application, the liquid lubricant composition is allowed to dry for a time sufficient to provide a wax-based lubricant coating having the characteristics described above. The drying of the liquid composition may optionally be enhanced by the use of heating equipment. Generally, the liquid composition will be deemed to have formed a lubricant coating once it has dried to a liquid carrier content of no more than about 5 wt. % and preferably no more than about 1 wt. %. However, in some instances, for example when non-volatile organic solvents are present, the liquid content of the lubricant coating may still be as high as about 20 wt. %.

The lubricant coating may initially be quite thin or quite thick. For example, the coating may be a 0.001 to 20 mil coating (where 1 mil=1/1000 inch). This includes embodiments where the lubricant coating is a 0.04 to 0.2 mil coating. After the coated surface is put into service, abrasion from objects transported by the conveyor may reduce the coating thickness. However, the low coefficient of friction and lubricating properties provided by the lubricant coatings remain for extended periods.

The wax-based lubricant coatings provided herein reduce the coefficients of friction of the surfaces to which they are applied. The lubricant coatings are capable of providing coefficients of friction of no more than about 0.15 as measured using a short track conveyor test. This includes embodiments where the lubricant coatings provide a surface having a coefficient of friction of no more than about 0.14, further includes embodiments where the coefficient of friction is no more than about 0.12, still further includes embodiments where the lubricant coatings provide coefficients of friction of no more than about 0.11, even further includes embodiments where the lubricant coatings provide surfaces having a coefficient of friction of no more than about 0.1, yet further includes embodiments where the lubricant coatings provide surfaces having a coefficient of friction of no more than about 0.08 and also includes embodiments where the lubricant coatings provide surfaces having a coefficient of friction of no more than about 0.06. The short track conveyor test used to measure the coefficient of friction values for the wax-based lubricant coatings described is detail in the Examples section below.

EXAMPLES

Exemplary wax-based lubricant coatings containing various waxes are presented here. The formulations for the liquid lubricant compositions from which the lubricant coatings are formed are provided in Table 1, below. The amounts of each component in the compositions are listed in weight percent based on the total weight of the liquid lubricant compositions. The amounts of water listed in Table 1 do not include the additional water introduced with the wax emulsions. The coefficients of friction for various containers traveling on the conveyor belt were measured using a short track conveyor test. The results are of these measurements are shown in Table 1.

The short track conveyor test was conducted as follows: the lubricant coating was applied onto a motor driven laboratory table top conveyor belt 102 as shown in FIG. 1 using a cheesecloth pad wetted with a liquid lubricant composition. The liquid lubricant composition was applied in an amount of about 1.0 to 1.2 mg/cm$^2$ until approximately 8 grams of the composition had been applied or about 2.0 to 2.2 mg/cm$^2$ until approximately 16 grams of the composition had been applied. The laboratory table top conveyor system 103 used was from Simplimatic Engineering with adjustable guide rails (not shown), casters (not shown), top conveyor belt, ¾ HP variable speed drive (not shown), including stainless steel drip pan (not shown). The short track conveyor was outfitted (equipped) with either a 7.5 inch wide polyacetal (REX 820 Table Top) or a stainless steel (REX SS 815 Table Top) conveyor belt (track), both from Rexnord Industries Inc., Grafton, Wis. for sample testing. Total conveyor belt length was 13 feet which provided a total track surface area of 8.125 sq. feet for sample coating and testing.

After application of one of the liquid lubricant compositions of Table 1 to the conveyor belt, the composition was allowed to dry at room temperature under ambient conditions for about 60 minutes until a wax-based lubricant coating resulted. At this point the water content of the resulting lubricant coating was less than about 5 wt. %. A number of containers 104 (i.e., either 12 ounce long-neck glass beer bottles, PET bottles or aluminum cans) were placed on the conveyor and held stationary while the conveyor was allowed to run at a speed of 1.35 meters/second. After the conveyor was started the containers 104 were placed onto the surface one by one into a load cell loop 106 connected to a strain gage load cell 108 (model no. 363-D3-50-20 pl from Process Instrument and Valves, Inc.). The load cell was interfaced with a digital indicator 112 (model IMS from Process Instruments and Valves, Inc.) and calibrated at regular intervals following the standard instructions provided with the meter. A calibration jig may be used to calibrate the load cell. The calibration jig 114 is an apparatus that suspends a low friction pulley (4") 116 off the back of the conveyor. Small gage calibration wire or cable 118 (of negligible mass) is secured to the load cell 108 and draped over the pulley 116. A weight 120 is secured to the opposite end during the calibration of the load cell 108. The total weight of the containers 104 and the load cell loop 106 was about 2814 grams for six glass bottles. When other containers were used, a load weight of 2800-3200 grams was used to determine the number of containers needed for the test. The conveyor with the containers was allowed to run for 30 minutes while drag levels were recorded at five minute intervals. The drag levels may be read manually or may be read from a strip chart recorder 110 (model BD 40 from Kipp-Zonen). After 30 minutes a final drag reading was recorded.

Once the dry run measurements were completed, the coated conveyor was sprayed with tap water from a 32 oz. trigger sprayer to wet the conveyor surface for two minutes at approximately 115 grams/minute. The conveyor was then run with the test containers in place and coefficient of friction measurements were taken at five minute intervals over a period of about 30 minutes, during which the conveyor was allowed to air dry. The results of these "wet" runs demonstrated that the lubricant coatings were able to maintain their low coefficient of friction values once the coatings have dried.

The lubricity of a particular lubricant coating was measured as the container drag in the horizontal plane divided by a known load in the vertical plane. Coefficient of friction values were measured using dry lubricant coatings and lubricant coatings that had been exposed to water. The coefficient of friction was used to measure the lubricity of the conveyor. To obtain this measurement, the final drag measurement was converted to a coefficient of friction (COF) measurement using the following calculation:

$$COF = \frac{\text{drag in the horizontal plane (from load cell)}}{\text{total container weight}}$$

Figure 2:
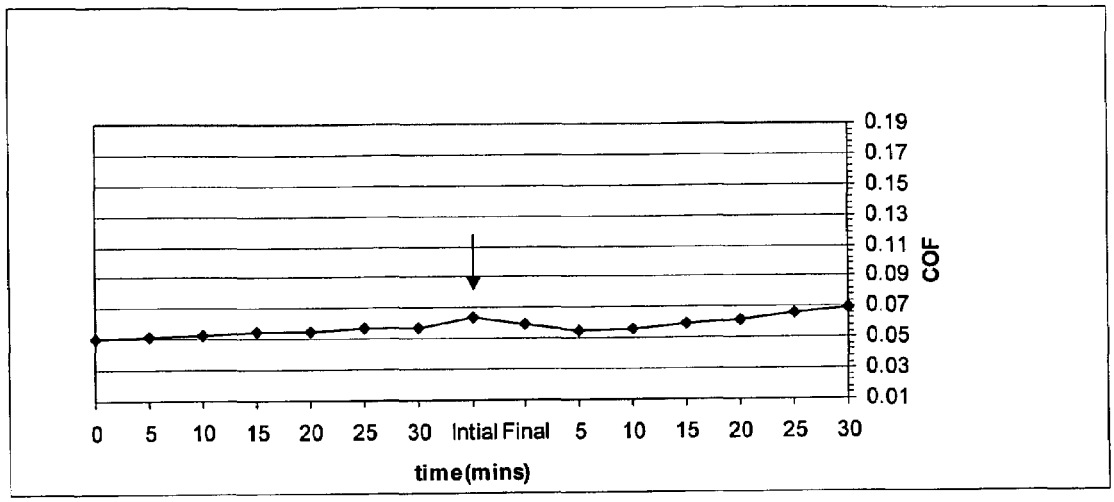
FIG. 2 shows a graph of the coefficient of friction versus time measured according to the short track conveyor test for a wax-based lubricant coating composed of 50% camauba wax and 50% oxidized polyethylene wax. This lubricant coating was made from liquid lubricant composition no. 1 in Table 1.
Figure 3:
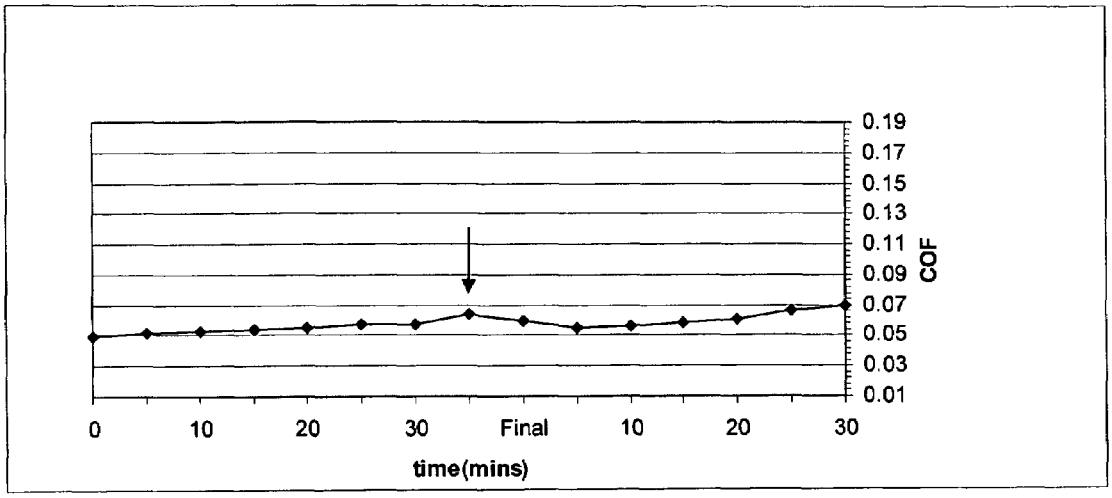
FIG. 3 shows a graph of the coefficient of friction versus time measured according to the short track conveyor test for a wax-based lubricant coating composed of 100% carnauba wax. This lubricant coating was made from liquid lubricant composition no. 2 in Table 1.

FIG. 2 shows the data for the coefficient of friction measurement for the lubricant coating made from liquid lubricant composition 1 in Table 1. FIG. 3 shows the data for the coefficient of friction measurement for the lubricant coating made from liquid lubricant composition 2 in Table 1. The arrows in the graphs indicate when the wetting of the lubricant coatings began. The coefficients of friction for each of the wax-based lubricant coatings made from liquid lubricant compositions 1-15 of Table 1 ranged from about 0.05 to about 0.2 under dry conditions and from about 0.03 to about 0.195 under wetted conditions.

TABLE 1

Liquid Lubricant Compositions and Coefficient of Friction Measurements of Lubricant Coatings

| | Wax Emulsion | Water (wt. %) | Averaged Hardness (dmm) ASTM D-5 | Deposition on Track Surface (mg/cm$^2$) | Track Type | Container Type | COF (Dry Lubricant Coating) | COF (Wetted Lubricant Coating) |
|---|---|---|---|---|---|---|---|---|
| 1 | Aquaslip 952[1] (20 wt. %) AC-316[2] (14.3 wt. %) | 65.7 | <1 | 1.0-1.2 | Polyacetal | Glass Bottles | 0.055-0.06 | 0.04-0.6 |
| 2 | Aquaslip 952 (40 wt. %) | 60 | 1 | 1.0-1.2 | Polyacetal | Glass Bottles | 0.05-0.06 | 0.05-0.07 |
| 3 | Aquaslip 952 (30 wt. %) AC 392[3] (10 wt. %) | 60 | <1 | 1.0-1.2 | Polyacetal | Glass Bottles | 0.07-0.08 | 0.05-0.07 |
| 4 | Aquaslip 952 (20 wt. %) AC 392 (20 wt. %) | 60 | <1 | 1.0-1.2 | Polyacetal | Glass Bottles | 0.06-0.075 | 0.03-0.065 |
| 5 | Aquaslip 952 (10 wt. %) AC 392 (30 wt. %) | 60 | <1 | 1.0-1.2 | Polyacetal | Glass Bottles | 0.18-0.2 | 0.14-0.2 |
| 6 | AC 392 (40 wt. %) | 60 | <0.5 | 1.0-1.2 | Polyacetal | Glass Bottles | 0.18-0.19 | 0.14-0.19 |
| 7 | Aquaslip 952 (20 wt. %) AC-316 (14.3 wt. %) | 65.7 | <1 | 1.0-1.2 | Polyacetal | Aluminum Cans | 0.115-0.13 | 0.08-0.13 |
| 8 | Aquaslip 952 (20 wt. %) AC-316 (14.3 wt. %) | 65.7 | <1 | 1.0-1.2 | Polyacetal | PET Bottles | 0.14-0.16 | 0.06-0.145 |
| 9 | Aquaslip 952 (20 wt. %) AC-392 (20 wt. %) | 60 | <1 | 1.0-1.2 | Stainless Steel | Glass Bottles | 0.10-0.12 | 0.045-0.105 |
| 10 | Aquaslip 952 (20 wt. %) AC 540[4] (16.7 wt. %) | 63.3 | 1.5 | 1.0-1.2 | Polyacetal | Glass Bottles | 0.18-0.20 | 0.14-0.195 |
| 11 | Aquaslip 952 (20 wt. %) AC 580[5] (20 wt. %) | 60 | 2.5 | 1.0-1.2 | Polyacetal | Glass Bottles | 0.185-0.195 | 0.145-0.195 |
| 12 | Aquaslip 952 (20 wt. %) AC 5120[6] (20 wt. %) | 60 | 4.5 | 1.0-1.2 | Polyacetal | Glass Bottles | 0.185-0.195 | 0.145-0.195 |
| 13 | Aquaslip 952 (20 wt. %) E-43[7] (12.5 wt. %) | 67.5 | <1 | 1.0-1.2 | Polyacetal | Glass Bottles | 0.13-0.15 | 0.095-0.145 |
| 14 | Aquaslip 952 (20 wt. %) ACX 611[8] (20 wt. %) | 60 | Not Available | 1.0-1.2 | Polyacetal | Glass Bottles | 0.06-0.08 | 0.045-0.07 |
| 15 | Aquaslip 952 (20 wt. %) AC-392 (20 wt. %) | 60 | <1 | 2.0-2.2 | Polyacetal | Glass Bottles | 0.06-0.075 | 0.035-0.065 |

[1]Aquaslip 952 is a 25% carnauba wax emulsion/dispersion commercially available from Lubrizol Corp., Wickliff, OH.
[2]AC 316 is a 35% oxidized polyethylene wax emulsion/dispersion prepared by JohnsonDiversey, Inc., Racine, WI., for internal use, the AC 316 wax is commercially available from Honeywell Inc., Honeywell, NJ.
[3]AC 392 is a 25% oxidized polyethylene wax emulsion/dispersion prepared by JohnsonDiversey, Inc., Racine, WI., for internal use, the AC 392 wax is commercially available from Honeywell Inc., Honeywell, NJ.

TABLE 1-continued

Liquid Lubricant Compositions and Coefficient of Friction Measurements of Lubricant Coatings

| Wax Emulsion | Water (wt. %) | Averaged Hardness (dmm) ASTM D-5 | Deposition on Track Surface ($mg/cm^2$) | Track Type | Container Type | COF (Dry Lubricant Coating) | COF (Wetted Lubricant Coating) |
|---|---|---|---|---|---|---|---|

[4]AC 540 is a 30% ethylene/acrylic acid copolymer wax emulsion/dispersion prepared by JohnsonDiversey, Inc., Racine, WI., for internal use, the AC 540 wax is commercially available from Honeywell Inc., Honeywell, NJ.
[5]AC 580 is a 25% ethylene/acrylic acid copolymer wax emulsion/dispersion made available from Honeywell Inc., Honeywell, NJ.
[6]AC 5120 is a 25% ethylene/acrylic acid copolymer wax emulsion/dispersion made available from Honeywell Inc., Honeywell, NJ.
[7]E-43 is a 40% polypropylene wax emulsion/dispersion prepared by JohnsonDiversey, Inc., Racine, WI., for internal use, the E-43 wax is commercially available from Eastman Chemical, Kingsport, TN.
[8]ACX 611 is a 25% experimental nylon grafted oxidized polyethylene wax emulsion/dispersion made available from Honeywell Inc., Honeywell, NJ.

For the purposes of the claims that follow, the "Short Track Conveyor Test" refers to the short track conveyor test described in the Examples section above, where the track is a polyacetal track, the containers are glass bottles and the liquid lubricant composition is applied in an amount of about 1.0 to 1.2 $mg/cm^2$ until approximately 8 grams have been has been applied and the liquid lubricant composition is allowed to dry at room temperature under ambient conditions for about 60 minutes before coefficient of friction measurements are taken.

As will be understood by one skilled in the art, for any and all purposes, particularly in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third, and upper third, etc. As will also be understood by one skilled in the art, all language such as "up to," "at least," "greater than," "less than," and the like, include the number recited and refer to ranges which can be subsequently broken down into sub-ranges as discussed above.

It is understood that the invention is not confined to the particular embodiments set forth herein as illustrative, but embraces all such forms thereof as come within the scope of the following claims.

What is claimed is:

1. A method for lubricating a conveyor surface, the method comprising forming a lubricant coating comprising at least about 70 weight percent wax and no more than about 30 weight percent liquid on at least a portion of the conveyor surfaces, wherein forming the lubricant coating comprises applying a liquid lubricant composition comprising at least one wax and at least one liquid carrier to at least a portion of conveyor surface and removing enough liquid carrier from the applied liquid lubricant composition to provide the lubricant coating, and further wherein the liquid lubricant composition comprises at least 30 weight percent wax and no more than about 60 weight percent wax, based on the total weight of the liquid lubricant composition.

2. The method of claim 1, wherein the lubricant coating comprises at least about 90 weight percent wax.

3. The method of claim 1, wherein the lubricant coating comprises at least about 98 weight percent wax.

4. The method of claim 1, wherein the lubricant coating comprises a liquid content of no more than about 5 weight percent based on the total weight of the lubricant coating.

5. The method of claim 1, wherein the lubricant coating comprises a mixture of at least two waxes.

6. The method of claim 5, wherein the lubricant coating comprises a mixture of carnauba wax and at least one additional wax.

7. The method of claim 6, wherein the at least one additional wax is a polyethylene wax.

8. The method of claim 6, wherein the lubricant coating comprises at least about 25 weight percent carnauba wax.

9. The method of claim 6, wherein the lubricant coating comprises from about 10 to about 80 weight percent carnauba wax.

10. The method of claim 6, wherein the at least one additional wax is a vegetable wax.

11. The method of claim 6, wherein the at least one additional wax is a animal-based wax.

12. The method of claim 6, wherein the at least one additional wax is a synthetic wax.

13. The method of claim 6, wherein the at least one additional wax is a mineral wax.

14. The method of claim 1, wherein the lubricant coating provides a coefficient of friction of no more than 0.1 as measured by a Short Track Conveyor Test.

15. The method of claim 1, wherein the lubricant coating provides a coefficient of friction of no more than 0.08 as measured by a Short Track Conveyor Test.

16. The method of claim 1, wherein the conveyor surface is a container-conveying surface and the lubricant coating is applied to a container-contacting area of the conveyor surface.

17. The method of claim 1, wherein the at least one liquid carrier comprises water.

18. The method of claim 1, wherein the at least one liquid carrier comprises an organic solvent.

19. A method for lubricating a conveyor surface, the method comprising forming a lubricant coating comprising at least about 70 weight percent wax and no more than about 30 weight percent liquid on at least a portion of the conveyor surface, wherein the lubricant coating comprises an animal-based wax.

20. A lubricated conveyor surface comprising a conveyor surface at least partially coated with a lubricant coating comprising at least about 70 weight percent wax and no more than about 30 weight percent liquid, wherein the lubricant coating comprises an animal-based wax.

* * * * *